US007625232B2

(12) United States Patent
Lin et al.

(10) Patent No.: US 7,625,232 B2
(45) Date of Patent: Dec. 1, 2009

(54) ELECTRICAL CONNECTOR WITH AN IMPROVED PRESSING MEMBER

(75) Inventors: Min-Han Lin, Tu-cheng (TW); Kuo-Chun Hsu, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/215,780

(22) Filed: Jun. 30, 2008

(65) Prior Publication Data

US 2009/0011651 A1 Jan. 8, 2009

(30) Foreign Application Priority Data

Jul. 2, 2007 (TW) ..... 96210736 U

(51) Int. Cl.
*H01R 12/24* (2006.01)
*H01R 13/15* (2006.01)

(52) U.S. Cl. ..... 439/495; 439/260

(58) Field of Classification Search ..... 439/495, 439/260, 67, 77
See application file for complete search history.

(56) References Cited

U.S. PATENT DOCUMENTS 5,727,968 A * 3/1998 Ito ..... 439/495
6,165,008 A * 12/2000 Wu et al. ..... 439/492
6,203,346 B1 * 3/2001 Wu et al. ..... 439/260
6,280,240 B1 8/2001 Chang
6,371,797 B1 * 4/2002 Kikuchi et al. ..... 439/496
6,475,025 B2 * 11/2002 Inoue ..... 439/495
6,524,124 B2 * 2/2003 Yamane ..... 439/260
6,533,606 B2 * 3/2003 Yamane ..... 439/495
6,790,073 B2 * 9/2004 Wu ..... 439/495
6,939,166 B2 * 9/2005 Chung ..... 439/495
7,063,559 B2 * 6/2006 Wang et al. ..... 439/495
7,291,039 B2 * 11/2007 Shin ..... 439/495
2002/0013086 A1 * 1/2002 Inoue ..... 439/495
2002/0115340 A1 * 8/2002 Yamane ..... 439/495
2003/0236024 A1 * 12/2003 Wu ..... 439/495
2003/0236026 A1 * 12/2003 Endo ..... 439/495
2005/0118861 A1 * 6/2005 Chung ..... 439/495
2005/0287865 A1 * 12/2005 Wang et al. ..... 439/495
2007/0054544 A1 * 3/2007 Hirata ..... 439/495
2007/0173106 A1 * 7/2007 Wei et al. ..... 439/495
2007/0173107 A1 * 7/2007 Wei et al. ..... 439/495
2007/0249217 A1 * 10/2007 Shiu et al. ..... 439/495

* cited by examiner

*Primary Examiner*—Michael C Zarroli
*Assistant Examiner*—Vladimir Imas
(74) *Attorney, Agent, or Firm*—Andrew C. Cheng; Wei Te Chung; Ming Chieh Chang

(57) ABSTRACT

An electrical connector includes an insulating housing defining a receiving cavity for receiving an FPC, a pressing member assembled on the insulating housing, a plurality of contacts received in the insulating housing and a pair of locking members retained on two ends of the insulating housing. The pressing member has a tongue plate inserted into the receiving cavity for urging the FPC. The tongue plate has a pair of standoff portions with a pair of depressed recesses thereon in order to engage with the locking members.

16 Claims, 7 Drawing Sheets

ELECTRICAL CONNECTOR WITH AN IMPROVED PRESSING MEMBER

BACKGROUND OF THE INVENTION

1. Field of the invention

The present invention relates to an electrical connector, and more particularly to an electrical connector connecting a sheet-like connection member such as an FPC (Flexible Printed Circuit) to a printed circuit board.

2. Description of Related Art

U.S. Pat. No. 6,280,240 discloses a conventional connector adapted for connecting an FPC. The electrical connector includes a housing having an insertion cavity for receiving the FPC, a plurality of conductive terminals disposed in the housing side by side along a longitudinal direction thereof, a pressing member which is movable between an opened position and a closed position along an insertion direction of the FPC, and a pair of locking members assembled on two ends of said housing. The pressing member has a tongue plate and a pair of latching arms separately extending along the tongue plate for latching with the locking members. When the FPC is assembled into the insertion cavity, said pressing member shifts from the opened position to the closed position, meanwhile, said tongue plate of the pressing member urges the FPC to electrically connect with the conductive terminals retained in said housing.

However, generally, a user can not judge easily whether the pressing member is in the closed position or not only by an engagement of said latching arms and said locking members, which makes the user hard to know the engagement of the tongue plate with the FPC in the insertion cavity. Moreover, the FPC will move away in said insertion cavity urged by the tongue plate if the tongue plate has a motion in said insertion cavity by an unexpected exterior force. Therefore, a new connector is desired to overcome the disadvantage of the prior art connector.

SUMMARY OF THE INVENTION

Accordingly, an object of the present invention is to provide an electrical connector for receiving an FPC, in which the FPC can be held tightly.

In order to achieve above-mentioned object, an electrical connector is provided which comprises an insulating housing defining an elongated receiving cavity, a plurality of contacts retained in the insulating housing, a pair of locking members retained in the insulating housing and a moveable pressing member assembled on the insulating housing including a tongue plate received in said receiving cavity. Each contact has at least one mating portion projecting into the receiving cavity. Each locking member has a locking part extending into the receiving cavity. The pressing member has a tongue plate which defines a pair of engaging portions thereon to engage with said locking parts of the locking members.

Other objects, advantages and novel features of the present invention will become more apparent from the following detailed description of the present embodiment when taken in conjunction with the accompanying drawings.

DETAILED DESCRIPTION OF THE INVENTION

The present invention shall be discussed hereinafter in terms of a preferred embodiment illustrated in the accompanying drawings. In the following description, numerous specific details are set forth in order for the reader hereof to gain a thorough understanding of the present invention. It will be obvious, however, to those skilled in the art that certain well-know elements may not be shown in detail in order to unnecessarily obscure the present invention.

Figure 1:
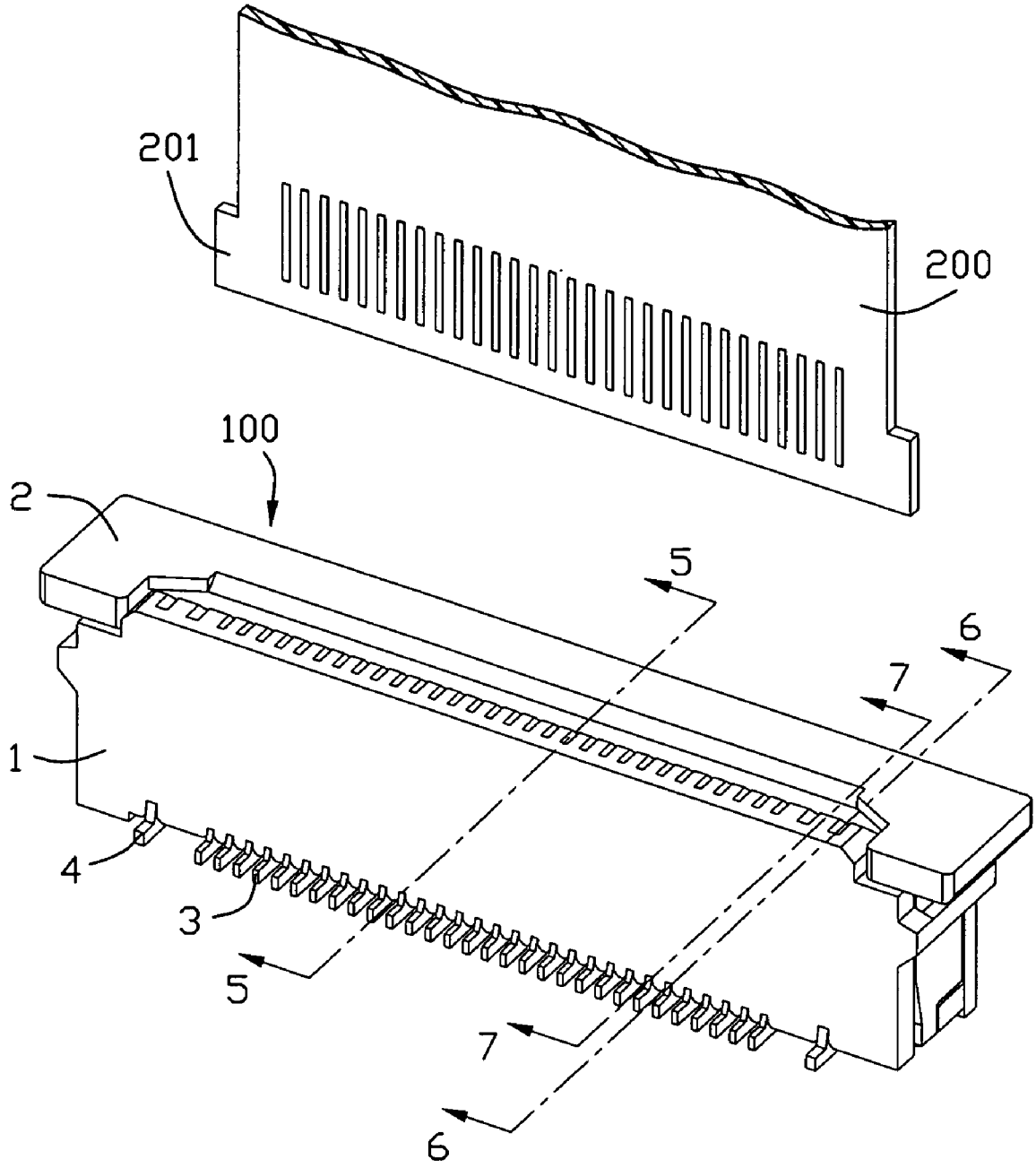
FIG. 1 is an assembled, perspective view of an electrical connector before a T-shaped FPC is assembled, in accordance with an embodiment of the present invention.

Referring to FIG. 1, an electrical connector 100 in accordance with the present invention is provided for receiving an FPC, especially a T-shaped FPC 200. The electrical connector 100 comprises an insulating housing 1, a pressing member 2 assembled downwardly on said insulating housing 1, a plurality of contacts 3 retained in the insulating housing 1 and a pair of locking members 4 retained near two ends of the row of said contacts 3.

Figure 2:
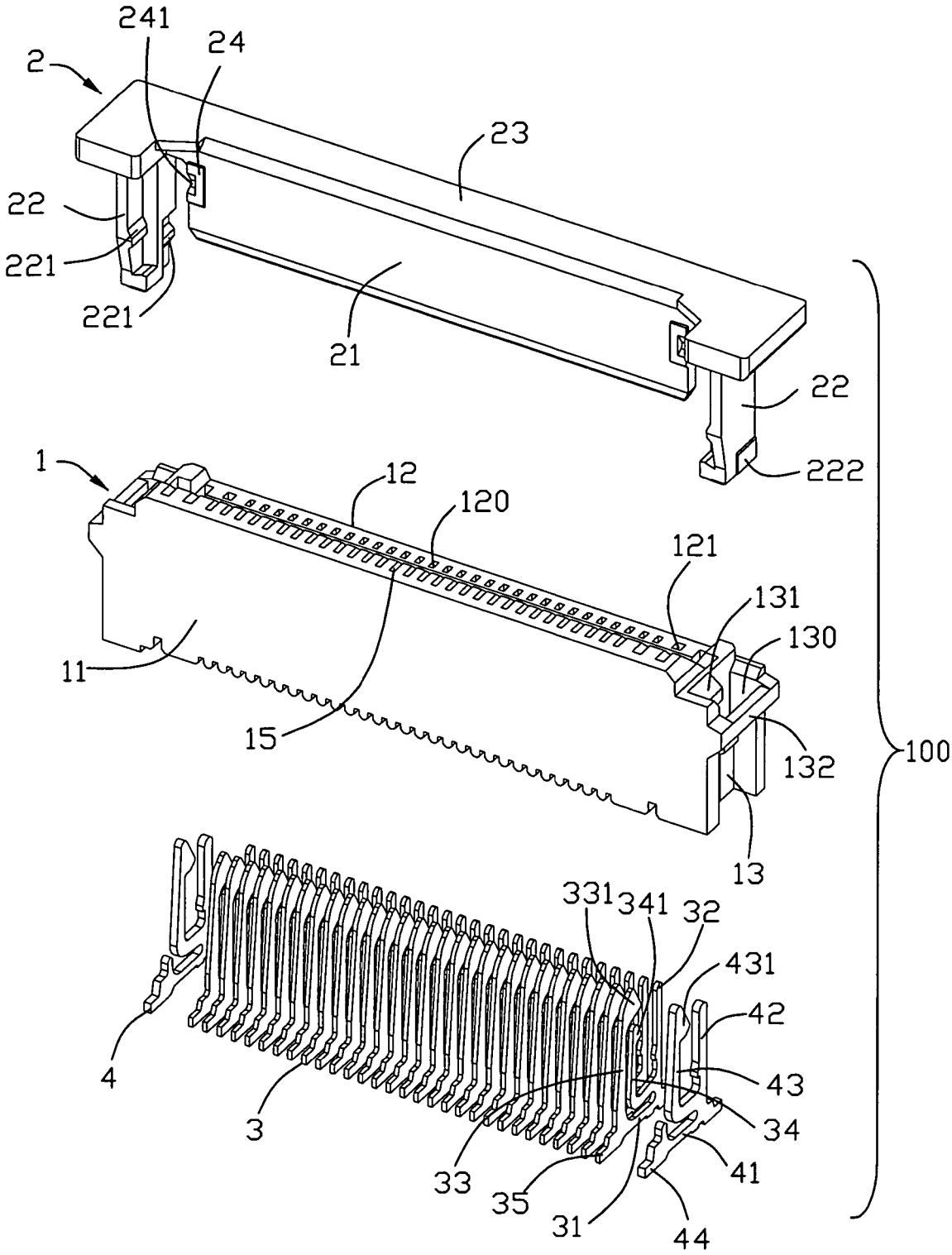
FIG. 2 is an exploded, perspective view of the electrical connector of FIG. 1.
Figure 3:
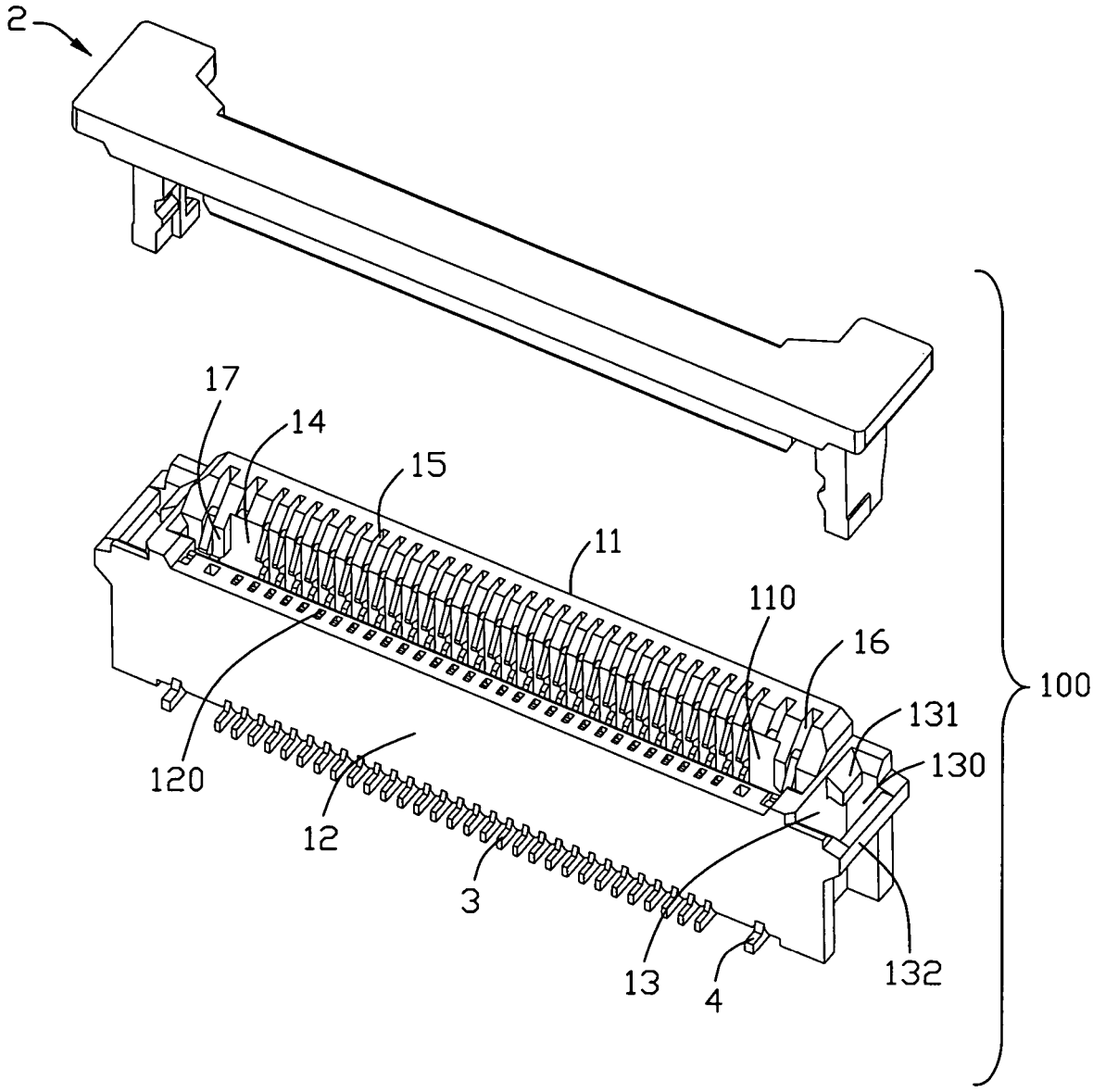
FIG. 3 is a partial exploded perspective view of the electrical connector.

Referring to FIGS. 2 and 3, the insulating housing 1 has a rectangular body with an elongated receiving cavity 14 which is defined by a pair of parallel sidewalls 11,12 and a pair of endwalls 13 of the insulating housing 1. Said parallel sidewalls comprise a first sidewall 11 and a second sidewall 12 linked with said endwalls 13. Said first sidewall 11 defines a plurality of passageways 15 and a pair of grooves 16 on a first inner surface 110 thereof for receiving said contacts 3 and said locking members 4 respectively. Said grooves 16 are located at two ends of the row of the passageways 15 and respectively extend into said receiving cavity 14. A pair of blocking portions 17 are defined on the first inner surface 110 respectively adjoining said grooves 16 and projecting into said receiving cavity 14. Said second sidewall 12 has a plurality of first holes 120 and second holes 121 corresponding to said passageways 15 and said grooves 16 for receiving said contacts 3 and said locking members 4 respectively. The endwalls 13 are perpendicular to said first sidewall 11 and second sidewall 12. Each endwall 13 has a locking portion on an outer surface thereof. The locking portion includes a guiding channel 130 defined by the sidewalls 11,12 projecting longitudinally beyond the endwall 13, a protrusion 131 projecting into the guiding channel 130 from the endwall 13 adjacent an opening of the receiving cavity 14 and a horizontal beam 132 linking the sidewalls 11,12 adjacent the opening of the receiving cavity 14.

Figure 4:
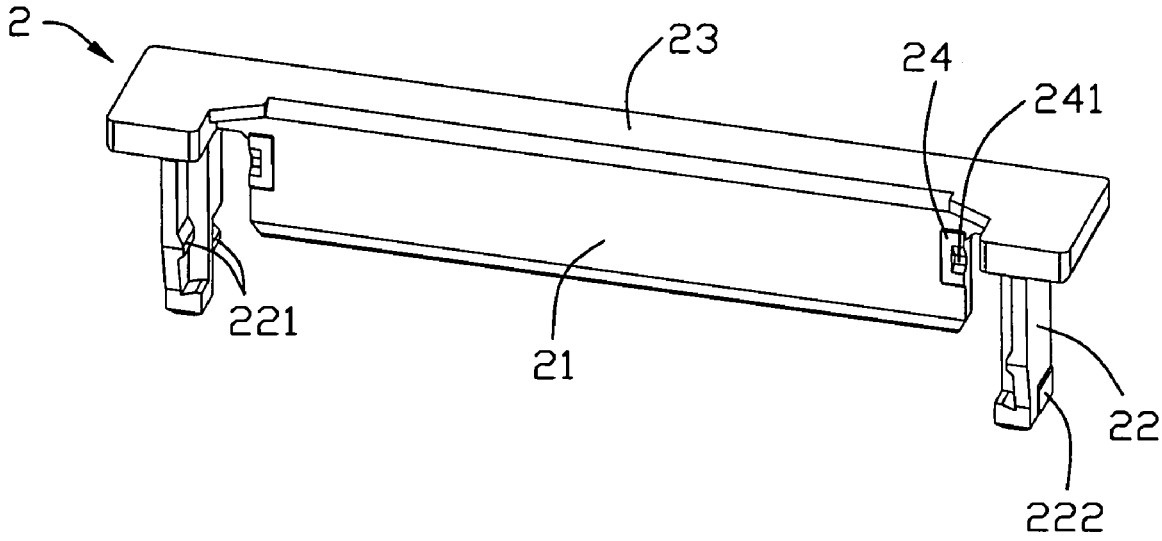
FIG. 4 is a perspective view of a pressing member of the electrical connector shown in FIG. 2.

Referring to FIGS. 2 and 4, the pressing member 2 is a longitudinal insulating body and includes a longitudinal tongue plate 21, a pair of latching arms 22 adjacent to and separately from two ends of said tongue plate 21 and an operating portion 23 from which said tongue plate 21 and said latching arms 22 extend vertically. The latching arm 22 has at least one rib 221 on an inner surface thereof for locking with said protrusion 131 of the endwall 13. An outer surface of said latching arm 22 defines a protruding plate 222 for locking with said horizontal beam 132. The pressing member 2 is assembled into the guiding channel 130 and then slides downward and upwardly.

Referring to FIG. 2, said contacts 3 are received in said passageways 15 of the insulating housing 1 and each includes a base portion 31 retained in a bottom of said receiving cavity 14, a holding arm 32 extending upwardly from said base portion 31 and received into said first hole 120 and a pair of soldering tails 35 extending outwards of the insulating housing 1 from said base portion 31. The contact 3 further includes a resilient mating portion which comprises a first mating portion 33 and a second mating portion 34 both extending into said passageway 15 of the first sidewall 11. Said two mating portions 33, 34 respectively have a mating tip 331,341 adapted for mating with said T-shaped FPC 200.

Referring to FIG. 2, the pair of said locking members 4 are retained in said grooves 16 of the first sidewall 11 and each has a similar configuration with said contact 3. Said locking member 4 also includes a base portion 41 received in a bottom of the receiving cavity 14, a holding arm 42 extending upwardly from said base portion 41, a resilient locking arm 43 extending from a bottom of said holding arm 42 and a pair of soldering portions 44 extending horizontally outwards of said insulating housing 1. Said holding arms 42 are received into said second holes 121 of the second sidewall 12, meanwhile, the locking arms 43 are received in said grooves 16 (as best shown in FIG. 3) with a protruding end 431 which forms a locking part and extends into said receiving cavity 14 for engaging with said tongue plate 21.

Figure 5:
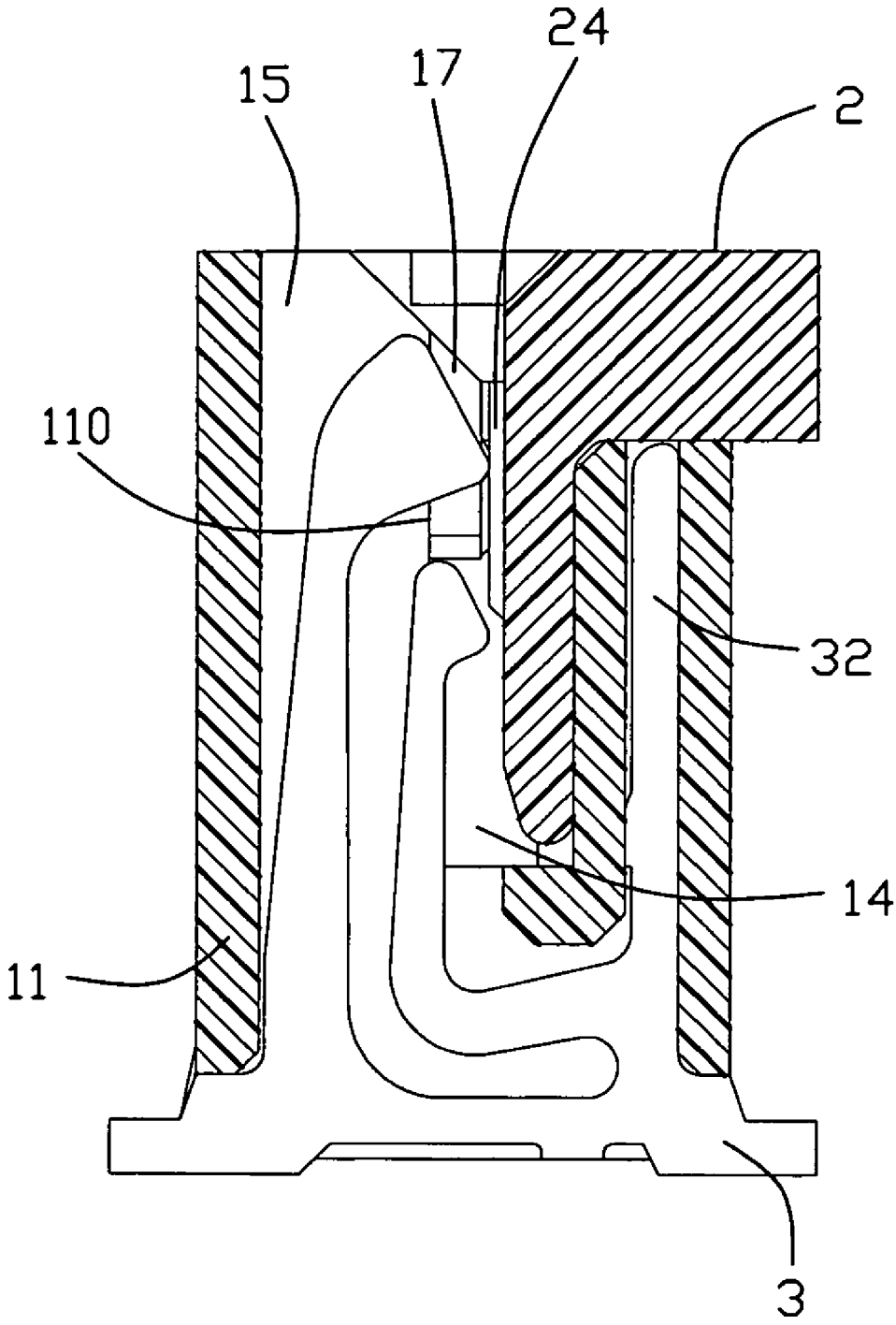
FIG. 5 is a cross-sectional view of FIG. 1 taken along line 5-5.

Referring to FIG. 5, the contacts 3 are retained in the passageways 15 and elastically project into said receiving cavity 14. The moveable pressing member 2 can slide into the receiving cavity 14. FIG. 5 shows the status of the pressing member 2 in the receiving cavity 14 without the insertion of the FPC, wherein the tongue plate 21 is inserted into the receiving cavity 14. The blocking portion 17 is beyond the inner surface 110 of the first sidewall 11 which will be described hereinafter. As shown in FIG. 2, the inner surface of the tongue plate 21 has a pair of standoff portions 24 facing said first sidewall 11 and formed on two opposite ends thereof respectively corresponding to said blocking portions 17. Said standoff portions 24 extend into said receiving cavity 14 much deeper than said blocking portion 17 along the insertion direction of the T-shaped FPC 200 (as shown in FIG. 5). The standoff portions 24 has a V-shaped depressed recess 241 on a surface thereon and running through an end edge thereof which is defined as an engaging portion of said tongue plate 21 (as shown in FIG. 4).

Figure 6:
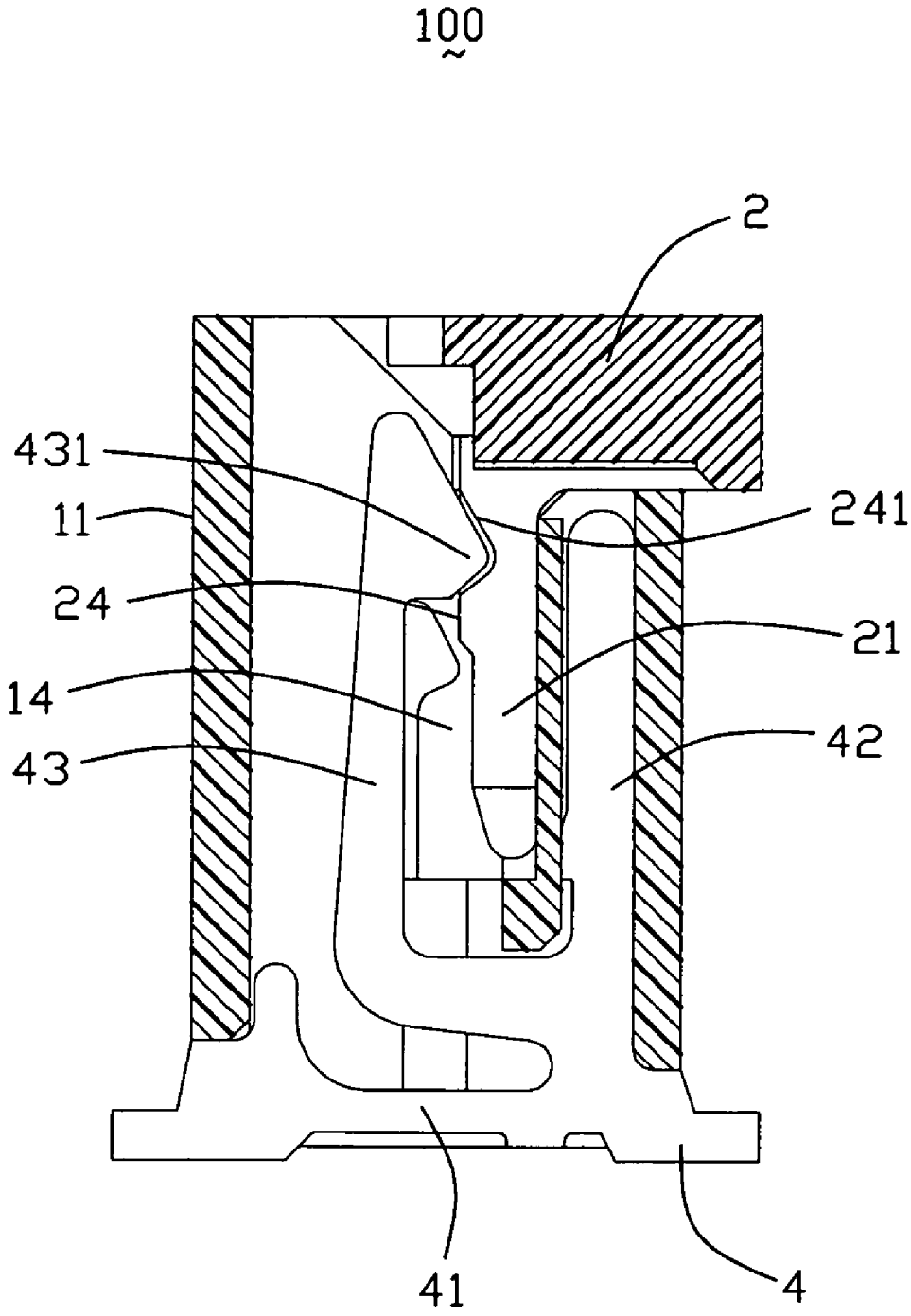
FIG. 6 is a cross-sectional view of FIG. 1 taken along line 6-6.

FIG. 6 shows the engagement of the locking members 4 with the standoff portions 24 without the insertion of the FPC 200. When the tongue plate 21 is inserted into the receiving cavity 14, the protruding end 431 of the locking arm 43 will mate with the standoff portion 24 first and then slide into the depressed recess 241. The locking engagement of the protruding end 431 with recess 241 not only ensures the tongue plate 21 being held securely in the receiving cavity 14, but also gives the user a strong feeling of the operation.

Figure 7:
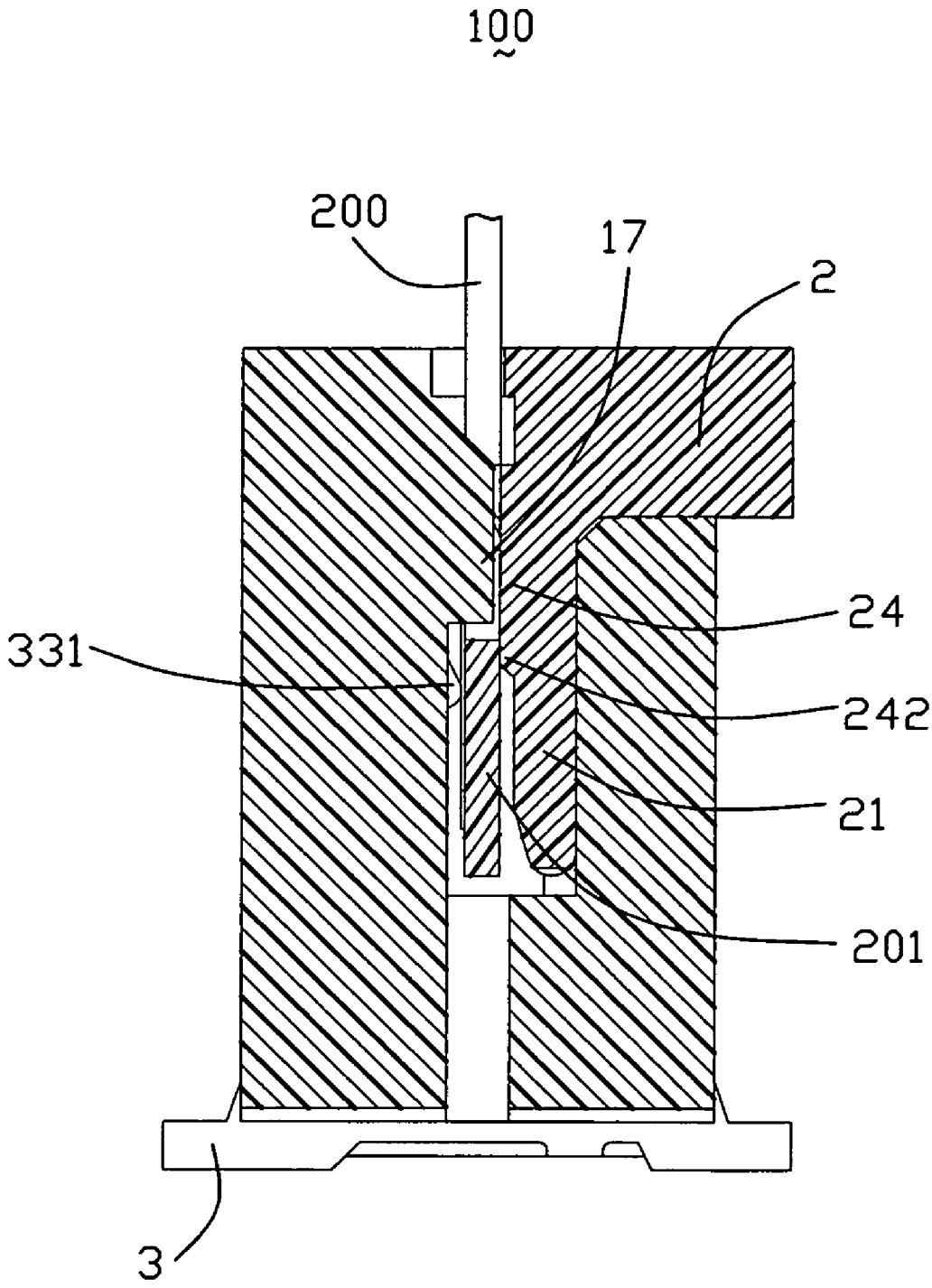
FIG. 7 is a cross-sectional view of FIG. 1 taken along line 7-7, with the T-shaped FPC assembled into the electrical connector.

Moreover, as shown in FIG. 7, wherein the T-shaped FPC 200 is inserted into the receiving cavity 14, a lower portion 242 of each standoff portion 24 abuts against a T-shaped portion 201 of the T-shaped FPC 200 and presses the T-shaped FPC 200 toward the mating tips 331 of the contacts 3, thereof not only the FPC 200 is connecting with the contacts 3 but also ensure the T-shaped portions 201 just be under the blocking portions 17 so as to stop the T-shaped FPC 200 from being pulled out of the receiving cavity 14. Besides, a motion of the FPC 200 towards said tongue plate 21 will be also stopped by said lower portion of the standoff portion 24, which makes the T-shaped FPC 200 be tightly held in the receiving cavity 14.

The electrical connector 100 in the embodiment has a firm connection between the FPC and the electrical connector 100 by forming a pair of standoff portions 24 with a pair of depressed recess 241 on the tongue plate 21. The user can feel the engagement of said depressed recesses 241 and said locking members 4, which is very convenient to the user. The blocking portions 17 of the insulating housing 1 make the T-shaped portion 201 be secured in the receiving cavity 14 firmly.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulating housing defining an elongated receiving cavity for receiving a flexible printed circuit board (FPC) along an inserting direction;

a plurality of contacts retained in the insulating housing, each having at least one mating portion projecting into the receiving cavity;

a pair of locking members retained in the insulating housing, each having a locking part extending into the receiving cavity;

a moveable pressing member assembled on the insulating housing, including a tongue plate received in said receiving cavity; wherein said tongue plate defines a pair of engaging portions thereon to engage with said locking parts of the locking members along a parallel direction to said inserting direction.

2. The electrical connector as claimed in claim 1, wherein each locking member has a resilient locking arm with a protruding end thereon extending into the receiving cavity to form said locking part, each engaging portion is a recess on an inner surface of the tongue plate to receive the protruding end only after the protruding end having a slide on the inner surface.

3. The electrical connector as claimed in claim 2, wherein the tongue plate has a pair of standoff portions on the surface, and the recess is defined on each standoff portion.

4. The electrical connector as claimed in claim 3, wherein the recess is a V-shaped depressed notch running through an end edge of the tongue plate.

5. The electrical connector as claimed in claim 3, wherein the insulating housing defines a pair of blocking portions projecting into said receiving cavity corresponding and opposite to said standoff portions respectively.

6. The electrical connector as claimed in claim 5, wherein each standoff portion is deeper than the blocking portion in an insertion direction of the pressing member into the receiving cavity.

7. The electrical connector as claimed in claim 1, wherein the insulating housing has a first sidewall defining a plurality of passageways for receiving said mating portions of the contacts, the tongue plate has a pair of standoff portions extending toward the first sidewall.

8. The electrical connector as claimed in claim 7, wherein the first sidewall of the insulating housing has a first inner surface with a pair of blocking portions at two ends of the passageways and projecting into said receiving cavity.

9. The electrical connector as claimed in claim 8, wherein each contact has a resilient mating portion comprising a first mating portion and a second mating portion respectively projecting into said receiving cavity.

10. An electrical connector for connecting with a T-shaped FPC, comprising:

an insulating housing having a longitudinal receiving cavity for receiving said T-shaped FPC;

a plurality of contacts retained in said insulating housing;

a pair of locking members retained in the insulating housing, each locking member having a locking part extending into said receiving cavity;

a pressing member assembled on the insulating housing, having a tongue plate received into said receiving cavity; wherein said tongue plate has a pair of engaging portions engaging with said locking parts of the locking members, said insulating housing has a pair of blocking portions extending into the receiving cavity for engaging with a T-shaped portion of the T-shaped FPC along a pulling out direction of the T-shaped FPC.

11. The electrical connector as claimed in claim 10, wherein the tongue plate has a pair of standoff portions on a surface, each standoff portion has a lower portion urging the T-shaped portion under the blocking portions.

12. An electrical connector comprising:

an insulative housing defining a elongated receiving slot therein;

a plurality of contacts including contacting sections extending into the receiving slot;

a moveable pressing member assembled to the housing and including a tongue plate inserted into the receiving slot;

at least one locking member assembled to the housing and having a locking arm extending into the receiving slot; and a flexible printed circuit (FPC) inserted into the receiving slot wherein the contacting sections indirectly engage the tongue plate but cooperating with the tongue plate to sandwiched the FPC while the locking arm is directly latchably engaged with the tongue plate.

13. The electrical connector as claimed in claim 12, wherein said tongue plate and FPC are inserted into the receiving slot along a same first direction.

14. The electrical connector as claimed in claim 12, wherein said locking member is assembled into the housing along a same second direction with the contact.

15. The electrical connector as claimed in claim 13, wherein said second direction is perpendicular to said first direction.

16. The electrical connector as claimed in claim 12, wherein said locking member is essentially hidden within the receiving slot.

* * * * *